US011162754B2

(12) United States Patent
Heckenlively

(10) Patent No.: US 11,162,754 B2
(45) Date of Patent: Nov. 2, 2021

(54) INTEGRALLY SUPPRESSED BARREL

(71) Applicant: Charles D. Heckenlively, Newport, WA (US)

(72) Inventor: Charles D. Heckenlively, Newport, WA (US)

( * ) Notice: Subject to any disclaimer, the term of this patent is extended or adjusted under 35 U.S.C. 154(b) by 0 days.

(21) Appl. No.: 17/014,724

(22) Filed: Sep. 8, 2020

(65) Prior Publication Data

US 2021/0071980 A1 Mar. 11, 2021

(51) Int. Cl.

| | |
|---|---|
| ***F41A 21/30*** | (2006.01) |
| ***F41A 21/02*** | (2006.01) |
| ***F41A 21/48*** | (2006.01) |
| ***F41A 21/28*** | (2006.01) |
| *F41A 21/32* | (2006.01) |

(52) U.S. Cl.

CPC ..... *F41A 21/30* (2013.01); *F41A 21/02* (2013.01); *F41A 21/28* (2013.01); *F41A 21/482* (2013.01); *F41A 21/32* (2013.01)

(58) Field of Classification Search

CPC ..... F41A 21/30; F41A 21/02; F41A 21/28; F41A 21/482; F41A 21/32

See application file for complete search history.

(56) References Cited

U.S. PATENT DOCUMENTS

| | | | | |
|---|---|---|---|---|
| 1,111,202 A * | 9/1914 | Westfall | F41A 21/30 | 89/14.4 |
| 1,140,578 A * | 5/1915 | Coulumbe | F41A 21/30 | 181/223 |
| 1,173,687 A * | 2/1916 | Thompson | F41A 21/30 | 89/14.4 |
| 1,227,897 A * | 5/1917 | Dunwoody | F41A 13/12 | 89/14.1 |

(Continued)

FOREIGN PATENT DOCUMENTS

FR 2756041 5/1998

*Primary Examiner* — Joshua E Freeman

(57) ABSTRACT

Disclosed is an integrally suppressed barrel which in an embodiment includes a firearm barrel, an outer sleeve, a front end cap, and a plurality of mesh layers. The firearm barrel has at least one set of hole groups to provide venting of propellant gas to a first space between the firearm barrel and the outer sleeve. At least one hole of at least one of the sets of hole groups is sized and threaded to mate with a removable socket head plug and are configurable by the user to vent, or to not vent, based both upon attributes of the ammunition desired for use and upon the desired degree of suppression. The holes of the at least one set of hole groups are elements of an open path for the gas, from behind a fired projectile, to outside the integrally suppressed barrel, as the projectile traverses the bore of the firearm barrel. Movement of the gas vented from forward holes dampens movement of the gas vented from rear holes. The plurality of mesh layers is located in the first space. The plurality of mesh layers (Continued)

disrupts and disperses the wavefront of the gas vented into the first space between the firearm barrel and the outer sleeve. The first space and the plurality of mesh layers are also elements of the open path for the gas. The front end cap threadably coupled to a threaded muzzle end of the firearm barrel applies compression to form a gas-tight seal at both ends of the outer sleeve.

19 Claims, 4 Drawing Sheets

(56) References Cited

U.S. PATENT DOCUMENTS 1,554,051 A * 9/1925 Walker ..... H01H 9/0005 89/14.3
2,337,840 A * 12/1943 Scott-Paine ..... F41A 13/12 89/14.1
2,935,912 A * 5/1960 Hartley ..... F41A 13/12 89/14.1
3,399,597 A * 9/1968 Perrine ..... F41A 21/30 89/14.4
3,727,513 A 4/1973 Wicks
4,426,909 A * 1/1984 Carter ..... F41A 21/30 89/1.816
4,530,417 A * 7/1985 Daniel ..... F41A 21/30 181/223
5,097,614 A * 3/1992 Strong ..... F41A 21/28 42/76.01
5,136,923 A * 8/1992 Walsh, Jr. ..... F41A 21/30 89/14.2
5,355,765 A 10/1994 Rogers
5,692,334 A * 12/1997 Christensen ..... F41A 21/02 42/76.02
6,374,718 B1 * 4/2002 Rescigno ..... F41A 21/30 89/14.4
6,789,454 B2 * 9/2004 Smith ..... F41A 21/02 42/76.02
7,182,014 B2 * 2/2007 Smith ..... F41A 21/02 42/76.02
7,587,969 B2 * 9/2009 Silvers ..... F41A 21/30 181/223
7,775,200 B2 * 8/2010 Anderson ..... F41A 21/02 124/83
7,882,883 B2 * 2/2011 Anderson ..... F41A 21/02 164/46
8,015,908 B2 * 9/2011 Kline ..... F41A 21/30 89/14.4
8,196,701 B1 * 6/2012 Oliver ..... F41A 21/30 181/223
8,695,475 B2 * 4/2014 Schneider ..... F41A 21/36 89/14.3
8,950,310 B2 * 2/2015 Storrs ..... F41A 21/30 89/14.1
9,546,838 B2 * 1/2017 Liskey ..... F41A 21/30
9,658,010 B1 * 5/2017 Oglesby ..... F41C 23/16
9,739,559 B2 * 8/2017 Bush ..... F41A 21/30
9,835,400 B2 12/2017 Barrett et al.
9,976,830 B2 * 5/2018 Leone ..... F41A 21/28
10,458,737 B2 * 10/2019 Schwartzkopf ..... F41A 21/30
10,533,819 B2 1/2020 Thomas
2006/0123983 A1 * 6/2006 Vais ..... F41A 21/30 89/14.3
2011/0265365 A1 * 11/2011 Alonso Tricio ..... F41A 21/18 42/78
2016/0003570 A1 * 1/2016 Tonkin ..... F41A 21/04 89/14.4
2017/0115084 A1 * 4/2017 Hailey ..... F41A 21/30
2017/0254609 A1 * 9/2017 Schoenlau ..... F41A 21/32
2017/0299291 A1 * 10/2017 Spector ..... F41A 13/12
2017/0350670 A1 * 12/2017 Grob ..... F41A 21/18
2018/0238652 A1 * 8/2018 Leone ..... F41A 21/28
2018/0238653 A1 * 8/2018 Kunsky ..... F41A 21/325
2018/0245871 A1 * 8/2018 Goggel ..... F41A 21/30
2018/0274873 A1 * 9/2018 Thomas ..... F41A 21/30
2019/0017768 A1 * 1/2019 Thomas ..... F41A 21/30
2019/0017773 A1 * 1/2019 Myers ..... F41A 19/13
2020/0166304 A1 * 5/2020 Martin ..... F41A 21/28
2020/0300566 A1 * 9/2020 Baker ..... F41A 21/22

* cited by examiner

INTEGRALLY SUPPRESSED BARREL

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

The present disclosure relates in general to firearms, specifically to barrels with integral elements which reduce the noise occurring upon discharge of the firearm.

A firearm casts a projectile such as a bullet a great distance by combusting a solid propellant which produces a gas, thereby creating pressure inside the firearm which is orders of magnitude above standard atmospheric pressure. This pressure is exerted not only on the projectile and the walls of the barrel and the cartridge, but in the case of an autoloading firearm, also the action and any gas system which cycles the action, where it is referred to as back pressure. When the pressurized gas exits the muzzle of the gun, it creates a blast wave in the atmosphere with a rapid rise time. That muzzle blast is harmful to hearing at close range, and alarming at longer ranges, having few if any analogues in day to day living or in the natural world. Often the projectile will exceed the speed of sound before it exits the barrel, the projectile creating in front of itself a shock wave which on exit adds to the noise.

A variety of ammunition usable in a given firearm is often manufactured. Among that variety may be a range of velocities available among offerings from multiple manufacturers. The range of velocities available for a given cartridge may vary from 20% to 50% or more in cases where subsonic and/or "hypersonic" offerings exist.

Existing suppressors often use an arrangment of baffles, and may be formed via CNC machinery to have geometries more complex than the non-suppressing barrel or the barrel portion itself. That complexity comes at a cost for manufacturing and for using.

Existing suppressors, whether using baffles or not, often lack any provision to a user for adjustment effective across the full range of ammunition velocities available. That lack may detract from either the performance of the suppressor across the full range of available ammunition, or from the effective utilization of the full range of available ammunition.

When the propellant of a cartridge is combusted, a minority percentage of the propellant mass results in solid products and not gaseous products. Some of those solids are deposited on every surface exposed to the combustion products, including the barrel, any suppressor, and in the case of an autoloading firearm, the action and any gas system which cycles the action. Those deposits are adherent fouling which accumulates with each cartridge fired and becomes detrimental to the use of the firearm.

One factor in the production, deposit, and location of fouling is the degree and timing of the pressure of the combustion products. While the firearm and suppressor are only pressurized for a brief time, the combustion products move at a speed comparable to the projectile itself until the projectile leaves the muzzle.

Existing suppressors, whether using baffles or not, often extend the time distribution of the pressure of the combustion products as a tradeoff to reduce the degree of pressure at some point during that time. Such tradeoffs may increase or redistribute fouling in the barrel, any suppressor, and in the case of an autoloading firearm, the action and any gas system which cycles the action.

Existing suppressors, whether using baffles or not, often become closed to the escape of propellant gas and solid combustion products at some point in the projectile's passage down the bore of the firearm, or for the entirety of that passage. During that period the back pressure on the action in the case of an autoloading firearm, and any gas system which cycles the action, is greater than it would be if the closure did not exist. That closure increases adherent fouling in the action in the case of an autoloading firearm and in any gas system which cycles the action.

Improvements in utility, simplicity, and fouling reduction are needed.

Figure 1A:
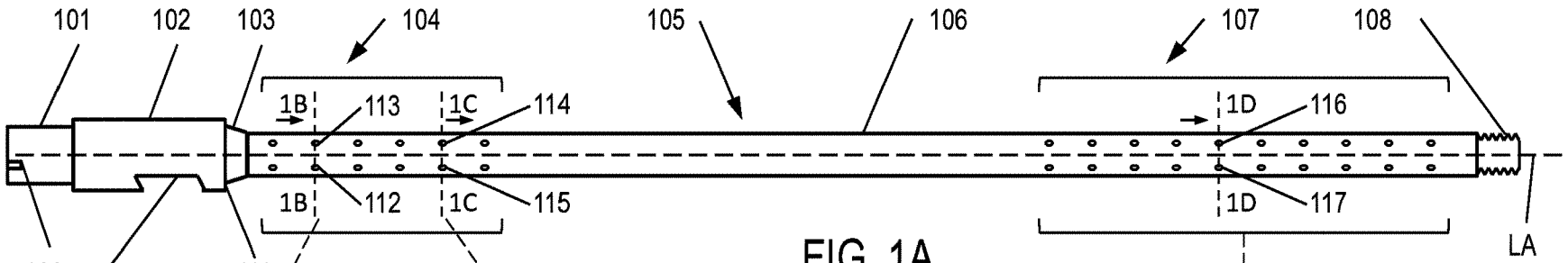
FIG. 1A is an elevation view of a firearm barrel according to the present disclosure.

Note all drawings are schematic and are not to scale. Note also that throughout this description, elements appearing in figures are assigned three-digit reference numbers, where the most significant digit is the figure number, and the two least significant digits are element-specific.

DETAILED DESCRIPTION

The embodiments in this discussion should be read as examples rather than as limitations on the apparatus and methods disclosed or claimed.

As used herein, whether in the description or claims, "plurality" indicates two or more. As used herein, whether in the description or claims, a "set" of elements includes two or more such elements. As used herein, whether in the description or claims, a "group" of elements includes two or more such elements. As used herein, whether in the description or claims, the terms "comprising", "including", "containing", "involving" and the like are open-ended, i.e. mean "including but not limited to."

Use of ordinal terms "first", "second", etc., whether in the description or the claims to modify an element, does not by itself connote any priority, precedence or order of one element relative to another, but is used merely to distinguish one element having a certain name from another element having a same name (but for use of the ordinal term).

As used in this description, the term "and/or" indicates that the listed elements are alternatives, but the alternatives also include any combination of the listed elements. As used in this description, the term "sized" and a resulting relation between elements of an embodiment according to the present disclosure refers to the relation as resulting upon assembly of the embodiment.

This description of embodiments is to be read along with the drawings.

The embodiment illustrated in the drawings is for an exemplary firearm (not shown) of a rifle type, however other embodiments may be for other types of firearms including but not limited to rifles, all rifle sub-types, pistols, all pistol sub-types, shotguns, and all shotgun sub-types.

FIG. 1A is an elevation view of an embodiment of a firearm barrel 105 according to the present disclosure. The firearm barrel 105 includes a barrel bore 120 therethrough. A longitudinal axis LA is defined by, and coaxial with, the centerline of the barrel bore 120. Cross sections of the firearm barrel on a vertical plane are defined as being perpendicular to the longitudinal axis LA for convenience of description. All end views are defined as being perpendicular to the longitudinal axis for convenience of description. The term "longitudinally" is defined as being parallel to the longitudinal axis for convenience of description. The terms "circumferentially" and "circumference" are defined as being perpendicular to the longitudinal axis for convenience of description. A fired projectile enters the barrel bore 120 at a chamber 101, passes forward through a rear barrel portion 102, a rear bevel 103, and a front barrel portion 106, and exits the barrel bore 120 thru a threaded muzzle end 108.

The firearm barrel 105 includes a chamber 101, a rear barrel portion 102, a rear bevel 103, an extractor notch 109, and an installation cavity 110, which collectively attach to the receiver of the exemplary firearm. The rear barrel portion 102 is sized to be circumferentially interior to the rear sleeve interior 204 of FIG. 2D as further described herein. The extractor notch 109 is sized and located on the chamber 101 for access by the extractor of the receiver of the exemplary firearm. The installation cavity 110 is sized and located on the rear barrel portion 102 for attaching the firearm barrel 105 to the receiver of the exemplary firearm. The installation cavity 110 is also sized for access through the cutout 203 of the outer sleeve 201 of FIG. 2A, as further described herein. In other embodiments the firearm barrel 105 may include other means in addition to or instead of the installation cavity 110 for attaching the barrel to the receiver of another exemplary firearm, for example a threaded barrel and a threaded receiver, or a threaded receiver and a threaded collar which slips over the barrel, or a transverse pin between the receiver and the barrel.

The firearm barrel 105 also includes a front barrel portion 106 extending forward between the rear bevel 103 and the threaded muzzle end 108. The front barrel portion 106 is sized to be circumferentially interior to the plurality of mesh layers 401 of FIG. 4A as further described herein. The front barrel portion 106 is also sized for the plurality of mesh layers 401 to be located longitudinally between the rear bevel 103 and the rear cap portion 302 of FIG. 3A, as further described herein. The front barrel portion 106 includes one or more breech end hole groups 104 which vent both propellant gas behind a fired projectile (not shown), as well as air compressed forward of the projectile, the air driven by the projectile's travel within the barrel. The vented gas and air proceed towards one or more muzzle end hole groups 107 as further described herein.

Each hole group of the breech end hole groups 104 includes a first lower right hole 112 and a first upper right hole 113. In the embodiment illustrated in the drawings, breech end hole groups 104 includes four hole groups, spaced at a distance equal to a first diameter of the front barrel portion 106. In other embodiments, the breech end hole groups 104 may include more or fewer hole groups. In other embodiments, the hole groups of the breech end hole groups 104 may be spaced a greater or lesser distance.

The breech end hole groups 104 also include one or more hole groups which are configurable by the user to vent, or to not vent, both propellant gas behind a fired projectile (not shown) as well as air compressed forward of the projectile. The act of configuring by the user is further described herein with FIG. 1C.

A hole group which is configurable by the user includes a second upper right hole 114 and a second lower right hole 115. In the embodiment illustrated in the drawings, the breech end hole groups 104 include two hole groups which are configurable by the user, spaced at a distance equal to the first diameter of the front barrel portion 106. In other embodiments, the breech end hole groups 104 may include more or fewer hole groups which are configurable by the user. In other embodiments, the hole groups which are configurable by the user may be spaced a greater or lesser distance.

As shown on the right side of FIG. 1A, the front barrel portion 106 also includes one or more muzzle end hole groups 107 which, like the breech end hole groups 104, vent both propellant gas behind a fired projectile (not shown) as well as air compressed forward of the projectile. Each hole group of the muzzle end hole groups 107 includes a third upper right hole 116 and a third lower right hole 117. In the embodiment illustrated in the drawings, the muzzle end hole groups 107 includes ten hole groups, spaced at a distance equal to the first diameter of the front barrel portion 106. In other embodiments, the muzzle end hole groups 107 may include more or fewer hole groups. In other embodiments, the hole groups of the muzzle end hole groups 107 may be spaced a greater or lesser distance.

Upon assembly of the embodiment, the front barrel portion 106 and the outer sleeve 201 form circumferentially inner and outer bounds of a first space, with the plurality of mesh layers 401 therein, as further described herein. The gas vented via the breech end hole groups 104 and muzzle end hole groups 107 travels more slowly than the gas inside the barrel, by moving in the first space, which has a larger volume than the barrel bore 120. The gas and air vented out the barrel via the muzzle end hole groups 107 travels in part back towards the receiver end of the firearm barrel 105, impinges upon the gas and air vented out the barrel via the breech end hole groups 104, which is travelling towards the muzzle end of the firearm barrel 105, and the respective movements of the bodies of vented gas and air is dampened.

The breech end hole groups 104 and the muzzle end hole groups 107 lie along an open path and reduce the back pressure in the barrel, and in the case of an autoloading firearm, in the action and any gas system which cycles the action, thus reducing the adherent fouling in those elements of the firearm. That open path is further described herein.

The firearm barrel 105 also includes a rear barrel shoulder 111. The rear barrel shoulder 111 is sized to be circumferentially interior to the rear sleeve interior 204 of FIG. 2D as further described herein. The rear barrel shoulder 111 is also sized to be in a first abutment with the rear ledge 205 of the outer sleeve 201 of FIG. 2D, as further described herein. The first abutment is further described herein with FIGS. 2D and 3A. The firearm barrel 105 also includes a threaded muzzle end 108, which is sized to mate with the threaded socket 306 of FIG. 3A as further described herein. The threaded muzzle end 108 is also sized for the cap shoulder 303 of FIG. 3A to be in a second abutment with the front sleeve surface 207 of FIG. 2D, as further described herein.

Figure 1D:
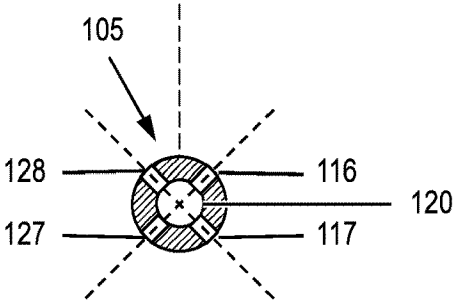
FIG. 1D is a right side third cross section of the firearm barrel on a third vertical plane.
Figure 1C:
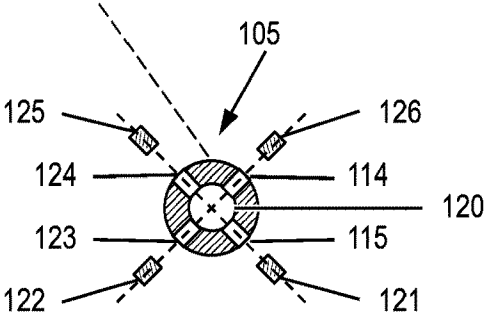
FIG. 1C is a right side second cross section of the firearm barrel on a second vertical plane.
Figure 1B:
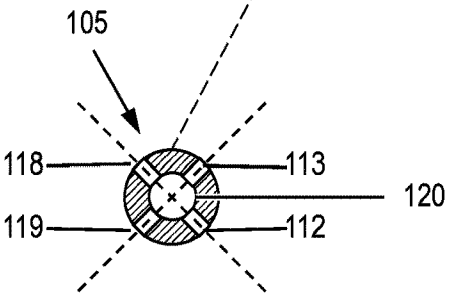
FIG. 1B is a right side first cross section of the firearm barrel on a first vertical plane.

FIG. 1B is a right side first cross section of the firearm barrel on a first vertical plane perpendicular to the longitudinal axis LA according to the present disclosure. The first cross section is representative for each of the hole groups in the breech end hole groups 104. In an embodiment of the front barrel portion 106 according to the present disclosure, in all sets of hole groups, all the hole groups each include four holes. In other embodiments one or more hole groups may contain more or fewer holes, with a minimum of two. Plural holes per hole group reduce imbalances in the force of the expanding propellant gas upon a fired projectile as the projectile passes a hole group. The imbalances may be detrimental to the accuracy of the path of the projectile after it leaves the integrally suppressed barrel. In an embodiment of the front barrel portion 106 according to the present disclosure, in all sets of hole groups, the hole groups in cross section are located at 45 degrees, 135 degrees, 225 degrees, and 315 degrees respectively to the vertical. In other embodiments one or more holes of one or more hole groups may be located at other non-zero angles relative to the vertical.

As described above, each hole group of the breech end hole groups 104 includes a first lower right hole 112 and a first upper right hole 113. Each hole group of the breech end hole groups 104 also includes a first upper left hole 118 and a first lower left hole 119.

The first lower right hole 112 shares a common center with the first upper left hole 118. The first upper right hole 113 shares a common center with the first lower left hole 119. Common centers simplify the firearm barrel 105. In other embodiments, one or more of the holes in one or more hole groups in the breech end hole groups 104 may have a center which is not shared with any other hole.

The firearm barrel 105 includes a barrel bore 120 as shown in FIGS. 1B thru 1F. The barrel bore 120 is sized to allow a fired projectile such as a bullet or slug to pass through the cap bore 307 without contact therewith, and also sized such that the barrel bore 120 is coaxially aligned with the cap bore 307.

FIG. 1C is a right side second cross section of the firearm barrel on a second vertical plane perpendicular to the longitudinal axis LA. The second cross section is representative for each of the hole groups which are configurable by the user.

As described above, a hole group which is configurable by the user includes a second upper right hole 114 and a second lower right hole 115. A hole group which is configurable by the user also includes a second lower left hole 123 and a second upper left hole 124.

The second lower right hole 115 shares a common center with the second upper left hole 124. The second upper right hole 114 shares a common center with the second lower left hole 123. Common centers simplify the firearm barrel 105. In other embodiments, one or more of the holes in one or more hole groups which are configurable by the user may have a center which is not shared with any other hole.

Each hole in each hole group which is configurable by the user is sized and threaded to mate with a socket head plug having matching threads. The length of the socket head plug is sized to be less than the wall thickness of the bore of the front barrel portion 106. The depth of the hole threading is sized to prevent the socket head plug from entering the bore of the front barrel portion 106.

Each hole group which is configurable by the user has 4 socket head plugs, a lower right socket head plug 121, a lower left socket head plug 122, an upper left socket head plug 125, and an upper right socket head plug 126. The user may configure each hole in each hole groups to vent, by removing a plug, or to not vent, by inserting a plug, based both upon attributes of the ammunition desired for use, as well as upon the desired degree of suppression. The attributes of the ammunition desired for use may include but not be limited to velocity, type of propellant powder, and type of projectile.

FIG. 1D is a right side third cross section of the firearm barrel on a third vertical plane perpendicular to the longitudinal axis LA. The third cross section is representative for each of the hole groups in the muzzle end hole groups 107.

As described above, each hole group in the muzzle end hole groups 107 includes a third upper right hole 116 and a third lower right hole 117. Each hole group of the muzzle end hole groups 107 also includes a third lower left hole 127 and a third upper left hole 128.

The third lower right hole 117 shares a common center with the third upper left hole 128. The third upper right hole 116 shares a common center with the third lower left hole 127. Common centers simplify the firearm barrel 105. In other embodiments, one or more of the holes in one or more hole groups in the muzzle end hole groups may have a center which is not shared with any other hole.

Figure 1F:
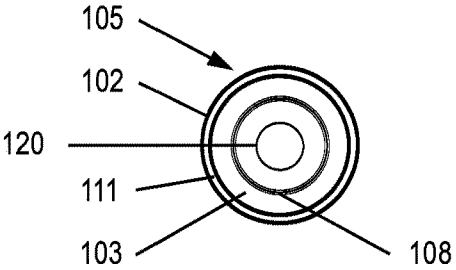
FIG. 1F is a front end view of the firearm barrel.
Figure 1E:
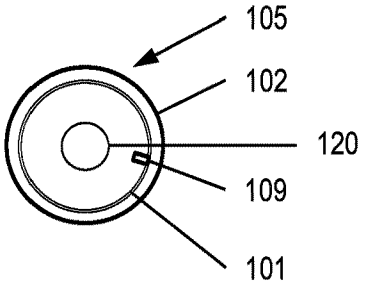
FIG. 1E is a rear end view of the firearm barrel.

FIG. 1E is a rear end view of the firearm barrel. As described above, the firearm barrel 105 includes a rear barrel portion 102, a barrel bore 120, an extractor notch 109, and a chamber 101.

FIG. 1F is a front end view of the firearm barrel. As described above, the firearm barrel 105 includes a rear barrel portion 102, a barrel bore 120, a rear barrel shoulder 111, a rear bevel 103, and a threaded muzzle end 108.

Figure 2A:
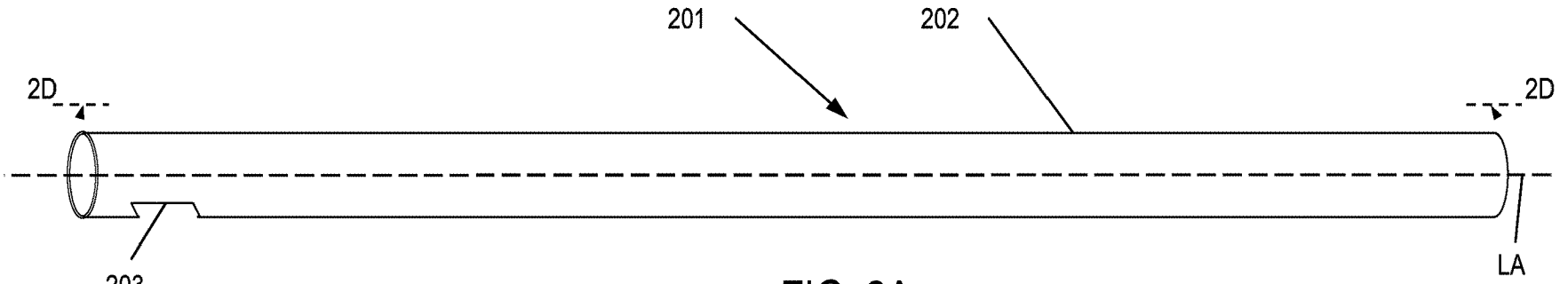
FIG. 2A is an elevation view of an outer sleeve according to the present disclosure.

FIG. 2A is an elevation view of an outer sleeve 201 according to the present disclosure. The outer sleeve 201 includes a sleeve exterior 202, and a cutout 203 which upon assembly of the embodiment aligns with the installation cavity 110 of the firearm barrel 105. The outer sleeve 201 is sized to be located longitudinally over the rear barrel portion 102, the rear bevel 103, the front barrel portion 106, and the rear cap portion 302 of FIG. 3A as further described herein. The cutout 203 is sized for access to the installation cavity 110 of the firearm barrel 105.

Figure 2C:
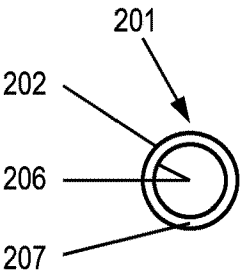
FIG. 2C is a front end view of the outer sleeve.
Figure 2B:
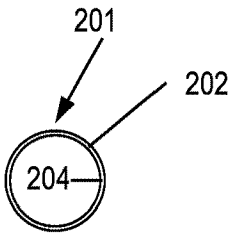
FIG. 2B is a rear end view of the outer sleeve.

FIG. 2B is a rear end view of the outer sleeve 201. As described above the outer sleeve includes the sleeve exterior 202. The outer sleeve 201 also includes a rear sleeve interior 204. The rear sleeve interior 204 is sized to be circumferentially exterior to the rear barrel portion 102.

FIG. 2C is a front end view of the outer sleeve 201. As described above the outer sleeve includes the sleeve exterior 202. The outer sleeve 201 also includes a front sleeve interior 206 which upon assembly of the embodiment is exterior to the plurality of mesh layers 401 as further described herein.

The front sleeve interior 206 is sized to provide the first space between the outer sleeve 201 and the front barrel portion 106 for insertion of the plurality of mesh layers 401 into the first space, and also for insertion of the rear cap portion 302 of the front end cap 301 into the first space, as further described herein.

Figure 2D:
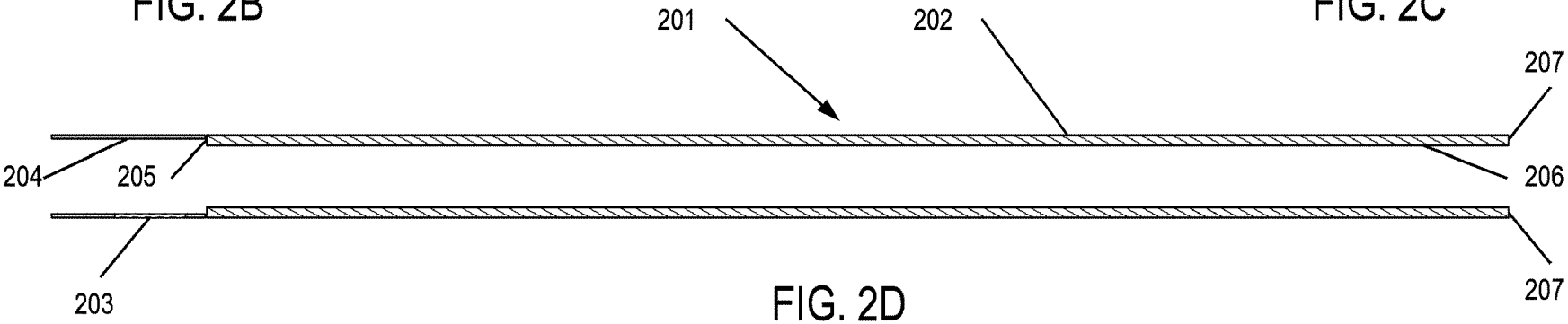
FIG. 2D is a cross section of the outer sleeve on a vertical plane.

FIG. 2D is a right side cross section of the outer sleeve 201 on a vertical plane parallel to and containing the longitudinal axis LA. As described above, the outer sleeve 201 includes the sleeve exterior 202, the front sleeve interior 206, front sleeve surface 207, the cutout 203, and the rear sleeve interior 204. The front sleeve interior 206 is sized to be circumferentially exterior to the rear bevel 103, the plurality of mesh layers 401, and the rear cap portion 302 as further described herein. The front sleeve surface 207 is sized to be in the second abutment with the cap shoulder 303.

The outer sleeve 201 also includes a rear ledge 205 which is sized to be in the first abutment with the rear barrel shoulder 111 of the firearm barrel 105. Upon assembly of the embodiment, the first abutment forms a gas tight seal under compression applied by the threaded socket 306 of the front end cap 301 threadably coupled with the threaded muzzle end 108 of the firearm barrel 105, as further described herein.

Figure 3B:
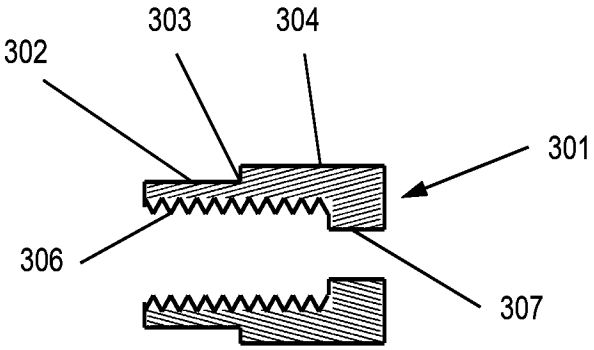
FIG. 3B is a cross section of the front end cap on a vertical plane.
Figure 3A:
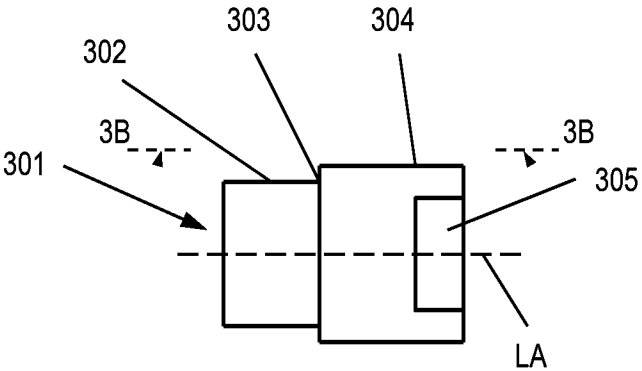
FIG. 3A is an elevation view of a front end cap according to the present disclosure.

FIG. 3A is an elevation view of a front end cap 301 according to the present disclosure. The front end cap 301 includes a rear cap portion 302, a cap shoulder 303, a front cap portion 304, and a pair of flats 305. The rear cap portion 302 is sized to be circumferentially interior to the front sleeve interior 206 and circumferentially exterior to the threaded muzzle end 108. The rear cap portion 302 is also sized for the plurality of mesh layers 401 to be located longitudinally between the rear bevel 103 and the rear cap portion 302, and for the cap shoulder 303 to be in the second abutment with the front sleeve surface 207. The cap shoulder 303 is likewise sized to be in the second abutment with the front sleeve surface 207.

The pair of flats 305 are sized to allow torque to be applied to the front end cap 301, thereby threadably coupling the threaded socket 306 and the threaded muzzle end 108, and thereby applying compression at the second abutment of the cap shoulder 303 with the front sleeve surface 207. The second abutment forms a gas tight seal under the applied compression of the threadably coupled threaded socket 306 and the threaded muzzle end 108.

FIG. 3B is a right side cross section of the front end cap 301 on a vertical plane parallel to and containing the longitudinal axis LA. The front end cap 301 also includes a threaded socket 306 and a cap bore 307. The threaded socket 306 is sized to mate with the threaded muzzle end 108 of the firearm barrel 105.

Upon assembly of the embodiment the threaded socket 306 of the front end cap 301 is threadably coupled onto the threaded muzzle end 108 of the firearm barrel 105.

The cap bore 307 is sized to allow a fired projectile such as a bullet or slug to pass through the cap bore 307 without contact therewith, and also sized such that the cap bore 307 is coaxially aligned with the barrel bore 120.

Figure 3D:
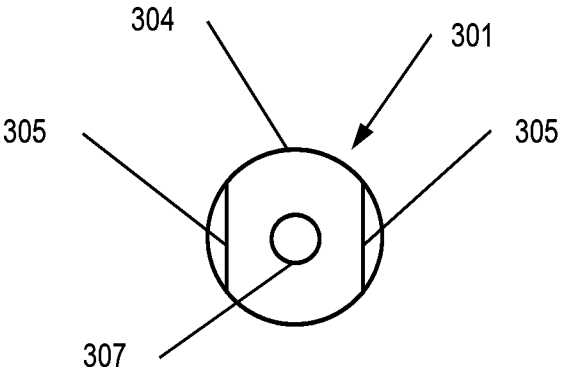
FIG. 3D is a front end view of the front end cap.
Figure 3C:
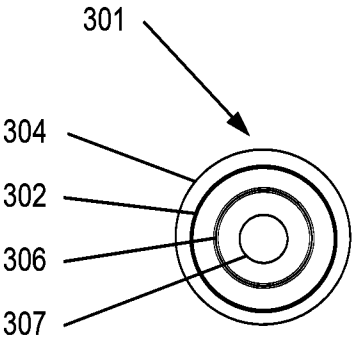
FIG. 3C is a rear end view of the front end cap.

FIG. 3C is a rear end view of the front end cap 301. As described above, the end cap includes the front cap portion 304, the rear cap portion 302, the threaded socket 306 and the cap bore 307.

FIG. 3D is a front end view of the front end cap 301. As described above, the end cap includes the front cap portion 304, the pair of flats 305, and the cap bore 307.

Figure 4A:
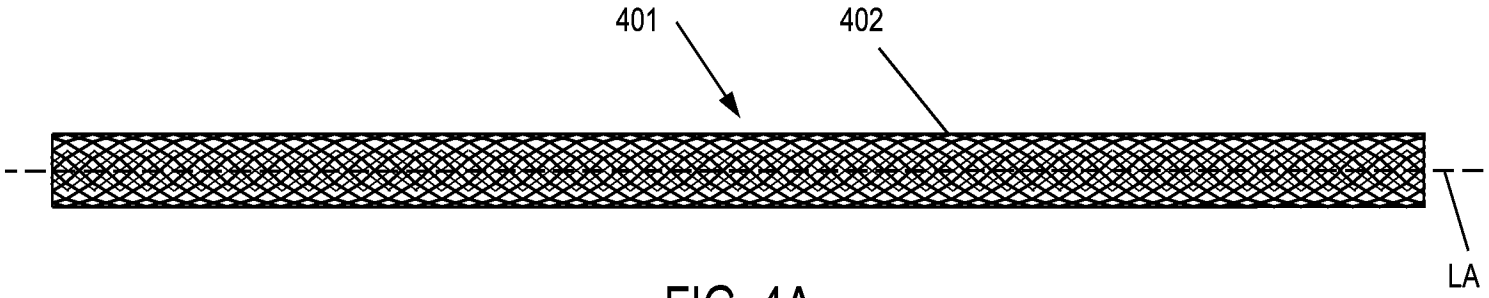
FIG. 4A is an elevation view of a plurality of mesh layers according to the present disclosure.

FIG. 4A is an elevation view of a plurality of mesh layers 401 according to the present disclosure. The plurality of mesh layers 401 includes a mesh exterior 402 and a mesh interior 403. The plurality of mesh layers 401 is sized to be circumferentially exterior to the front barrel portion 106, and also sized to be circumferentially interior to the front sleeve interior 206. The plurality of mesh layers 401 is also sized to be located longitudinally between the rear bevel 103 and the rear cap portion 302. The plurality of mesh layers 401 disrupts and disperses the wavefront of gas vented into the first space between the front barrel portion 106 and the outer sleeve 201. As shown in FIG. 4A of the embodiment according to the present disclosure, the plurality of mesh layers 401 includes 2 layers. In other embodiments, the plurality of mesh layers 401 may include 3 or more layers.

Figure 4B:
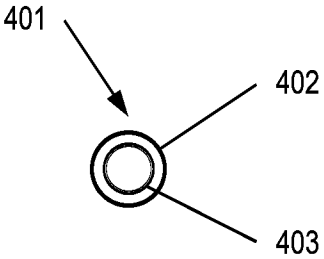
FIG. 4B is an end view of the front and rear of the plurality of mesh layers.

FIG. 4B is an end view of the front and rear of the plurality of mesh layers 401. As described above, the plurality of mesh layers 401 includes the mesh exterior 402 and the mesh interior 403.

The breech end hole groups 104 and the muzzle end hole groups 107 are elements of an open path allowing the escape of propellant gas and solid combustion products for the entirety of the projectile's passage down the bore of the front barrel portion 106, thus reducing the back pressure on the action in the case of an autoloading firearm, and on any gas system which cycles the action, and therefor reducing adherent fouling in the action and any gas system. The open path includes the barrel bore 120 rearward of the fired projectile, the holes of the breech end hole groups 104 and the muzzle end hole groups 107 which are rearward of the projectile, the first space between the front barrel portion 106 and the outer sleeve 201, the plurality of mesh layers 401, the holes of the breech end hole groups 104 and the muzzle end hole groups 107 which are forward of the projectile, the barrel bore 120 forward of the projectile, the cap bore 307 of the front end cap, and a second space exterior to the integrally suppressed barrel.

Any suitable materials may be used for the integrally suppressed barrel and its elements described herein. The elements may be formed of appropriate metals or alloys such as aluminum, steel, titanium, or others. In one representative but non-limiting example, the firearm barrel 105 may be made from steel. The outer sleeve 201 for example may be made from aluminum. The front end cap 301 for example may be made from aluminum. The plurality of mesh layers 401 for example may be made from stainless steel.

What is claimed is:

1. An integrally suppressed barrel for a firearm, the integrally suppressed barrel comprising: a firearm barrel, an outer sleeve, a front end cap; and a plurality of mesh layers; wherein said firearm barrel comprises a front barrel portion which includes a plurality of holes; wherein at least one hole of the plurality of holes is threaded and configured to receive a removable socket head plug.

2. The integrally suppressed barrel of claim 1,
wherein the firearm barrel further comprises:
a chamber, a rear barrel portion, a rear bevel,
a threaded muzzle end, an installation cavity, a rear barrel shoulder, and a barrel bore.

3. The integrally suppressed barrel of claim 1,
wherein the outer sleeve further comprises:
a sleeve exterior, a cutout, a rear sleeve interior, a rear ledge, a front sleeve interior,
and a front sleeve surface.

4. The integrally suppressed barrel of claim 3, wherein
the rear barrel portion is circumferentially interior to the rear sleeve interior.

5. The integrally suppressed barrel of claim 3, wherein
the rear barrel shoulder is circumferentially interior to the rear sleeve interior.

6. The integrally suppressed barrel of claim 1,
wherein the front end cap further comprises:
a rear cap portion, a cap shoulder, a front cap portion, a pair of flats, a threaded socket, and a cap bore.

7. The integrally suppressed barrel of claim 3, wherein
the rear barrel shoulder is in a first abutment with the rear ledge of the outer sleeve.

8. The integrally suppressed barrel of claim 6, wherein
the plurality of mesh layers are located longitudinally between the rear bevel and the rear cap portion.

9. The integrally suppressed barrel of claim 6, wherein
the threaded muzzle end is mated with the threaded socket.

10. The integrally suppressed barrel of claim 6, wherein
the cap shoulder is in a second abutment with the front sleeve surface.

11. The integrally suppressed barrel of claim 10, wherein
the pair of flats are operable to allow torque to be applied to the front end cap,
thereby threadably coupling the threaded socket and the threaded muzzle end,
thereby applying compression at the first abutment of the rear ledge with the rear barrel shoulder and
at the second abutment of the cap shoulder with the front sleeve surface.

12. The integrally suppressed barrel of claim 6, wherein
the barrel bore is smaller than the cap bore and is coaxially aligned with the cap bore.

13. The integrally suppressed barrel of claim 6, wherein
the outer sleeve is located longitudinally over rear barrel portion, the rear bevel, the front barrel portion,
and the rear cap portion.

14. The integrally suppressed barrel of claim 6, wherein
the front sleeve interior is circumferentially exterior to the rear bevel, the plurality of mesh layers,
and the rear cap portion.

15. The integrally suppressed barrel of claim 6, wherein
the rear cap portion is circumferentially exterior to the threaded muzzle end.

16. The integrally suppressed barrel of claim 6, wherein
(a) the barrel bore,
(b) at least two holes of the plurality of holes,
(c) a first space
circumferentially between
the front barrel portion and
the outer sleeve and
longitudinally between
the rear barrel shoulder and
the rear cap portion,
(d) the plurality of mesh layers, and
(e) the cap bore of the front end cap,
are included in an open path
from one of the at least two holes of the plurality of holes,
to a second space exterior to the integrally suppressed barrel.

17. The integrally suppressed barrel of claim 1,
wherein the plurality of mesh layers further comprises:
a mesh exterior and a mesh interior.

18. The integrally suppressed barrel of claim 1, wherein
the front barrel portion is circumferentially interior to the plurality of mesh layers.

19. An integrally suppressed barrel for a firearm, the integrally suppressed barrel comprising:
a firearm barrel and an outer sleeve;
wherein the firearm barrel further includes:
an installation cavity;
wherein the outer sleeve further includes:
a cutout;
wherein the cutout of the outer sleeve includes access to the installation cavity.

* * * * *